US008910480B2

(12) United States Patent
Suria et al.

(10) Patent No.: US 8,910,480 B2
(45) Date of Patent: Dec. 16, 2014

(54) FUEL INJECTOR WITH RADIALLY INCLINED VANES

(75) Inventors: Federico Suria, Alassio (IT); Nickolaos Pilatis, Warrington (GB)

(73) Assignee: Rolls-Royce PLC, London (GB)

( * ) Notice: Subject to any disclaimer, the term of this patent is extended or adjusted under 35 U.S.C. 154(b) by 1168 days.

(21) Appl. No.: 11/808,663

(22) Filed: Jun. 12, 2007

(65) Prior Publication Data

US 2007/0289306 A1 Dec. 20, 2007

(30) Foreign Application Priority Data

Jun. 15, 2006 (GB) ..... 0611841.8

(51) Int. Cl.

| | |
|---|---|
| ***F02C 1/00*** | (2006.01) |
| ***F02G 3/00*** | (2006.01) |
| ***F23D 11/10*** | (2006.01) |
| ***F23R 3/14*** | (2006.01) |

(52) U.S. Cl.

CPC ..... *F23D 11/107* (2013.01); *F23R 3/14* (2013.01); *F23D 2900/11101* (2013.01)

USPC ..... 60/743; 60/748; 60/740; 60/737; 60/747

(58) Field of Classification Search

USPC ..... 60/743, 748, 740, 737, 747

See application file for complete search history.

(56) References Cited

U.S. PATENT DOCUMENTS

| | | | | |
|---|---|---|---|---|
| 5,431,019 | A | 7/1995 | Myers | |
| 6,272,840 | B1 * | 8/2001 | Crocker et al. | 60/776 |
| 6,622,488 | B2 * | 9/2003 | Mansour et al. | 60/740 |
| 6,968,692 | B2 * | 11/2005 | Chin et al. | 60/737 |
| 7,669,420 | B2 * | 3/2010 | Spooner | 60/743 |
| 2002/0011064 | A1 * | 1/2002 | Crocker et al. | 60/39.06 |
| 2005/0097889 | A1 * | 5/2005 | Pilatis et al. | 60/743 |
| 2006/0070237 | A1 * | 4/2006 | Johnson et al. | 29/890.02 |
| 2007/0157616 | A1 * | 7/2007 | Hernandez et al. | 60/740 |

FOREIGN PATENT DOCUMENTS

| | | |
|---|---|---|
| DE | 2 026 883 AB | 12/1971 |
| GB | 1 366 144 SP | 9/1974 |
| GB | 2 276 715 A | 10/1994 |

* cited by examiner

*Primary Examiner* — Craig Kim

(74) *Attorney, Agent, or Firm* — Jeffrey S. Melcher; Manelli Selter PLLC

(57) ABSTRACT

A fuel injector comprises a plurality of swirler vane passages defined between swirler vanes. Each vane is leant with respect to the true radius of the swirler. The pressure distribution through the swirler passages is improved and the flow of air over a prefilmer located at the radially outer edges of the swirl vanes is improved and consequently atomization of fuel is improved and levels of NOx is reduced.

13 Claims, 8 Drawing Sheets

PRIOR ART

PRIOR ART

FUEL INJECTOR WITH RADIALLY INCLINED VANES

CROSS-REFERENCE TO RELATED APPLICATIONS

This application claims priority to GB 0611841.8, filed 15 Jun. 2006.

BACKGROUND OF THE INVENTION

The invention relates to fuel injectors suitable for use in a combustor of a gas turbine engine and in particular fuel injectors suitable for use in lean burn combustors of a gas turbine engine.

With reference to FIG. 1, a ducted fan gas turbine engine generally indicated at 10 comprises, in axial flow series, an air intake 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

The combustion equipment comprises one or more combustion chambers and fuel and air is injected into the, or each, combustion chamber through one or more fuel injectors. Where the combustion chamber is an annular combustion chamber a number of fuel injectors are circumferentially spaced along an upstream bulkhead of the combustion chamber.

Whilst the majority of the air flowing through a gas turbine engine passes through the combustion it is typically only a small proportion that passes through the fuel injector itself. The small proportion, around 10 to 15% of the total air entering the combustor, travels relatively slowly and provides a primary combustion point for the fuel injected and maintains the continuous combustion required for operation of a gas turbine. The remaining air enters the combustion chamber enters downstream of this primary zone and both dilutes the hot air caused by combustion of the fuel and provides cooling to protect the walls of the combustor.

NOx is a pollutant that may be formed at high temperatures as a by-product of the combustion process. To avoid production of such a pollutant, more recent "lean burn" fuel injectors propose increasing the flow of air into the combustor through the injectors to around 70% of the total airflow entering the combustor. These injectors typically have a pilot injector located around a central axis and a coaxial main injector. The pilot injector is continually fed with fuel and a specified percentage of air. The main injector is fed with a continual flow of air and an intermittent flow of fuel for times when high engine power is required.

The air steam within both the pilot and main injectors is induced to swirl by the provision of swirl vanes that extend radially between an inner hub and an outer, circumferentially extending, periphery.

The flow of air through the main injector is generally larger than that of the pilot injector. Fuel is fed to an annular outlet within the main injector that allows the fuel to flow in an annular film along an atomiser filmer lip. The annular film of liquid fuel is entrained within the much more rapidly flowing and swirling air stream. The air streams cause the annular film of fluid to be atomised into small droplets dispersed within the stream.

At high volumetric air flows, typical of lean burn injectors, non uniform air flow from the swirlers affects the flow quality of the air on the filmer lip. This in turn affects the atomisation performance of the air flow on the fuel and can lead to higher NOx production than desired.

It is an object of the present invention to seek to address these and other problems and to seek to provide an improved fuel injector.

SUMMARY OF THE INVENTION

According to a first aspect of the present invention there is provided a fuel injector for a combustor of a gas turbine engine the fuel injector having swirler means, the swirler means having an outer periphery and an inner periphery arranged coaxially about an axis and a plurality of vanes spaced circumferentially and extending between the inner and outer periphery; wherein adjacent vanes define an axially extending vane passage therebetween, the vanes providing the vane passage with a pressure surface and an opposing suction surface; the vanes being radially inclined at an angle of between 5° and 20° to the true radius of the injector.

Preferably the outer periphery extends axially into a prefilmer. The prefilmer may comprise at least one aperture for the supply of fuel therethrough.

The fuel injector of the invention may be incorporated in a combustor assembly. The combustor assembly may form part of a gas turbine.

BRIEF DESCRIPTION OF THE DRAWINGS

The invention will now be described, by way of example only, with reference to the following figures in which.

DETAILED DESCRIPTION OF THE INVENTION

Figure 1:
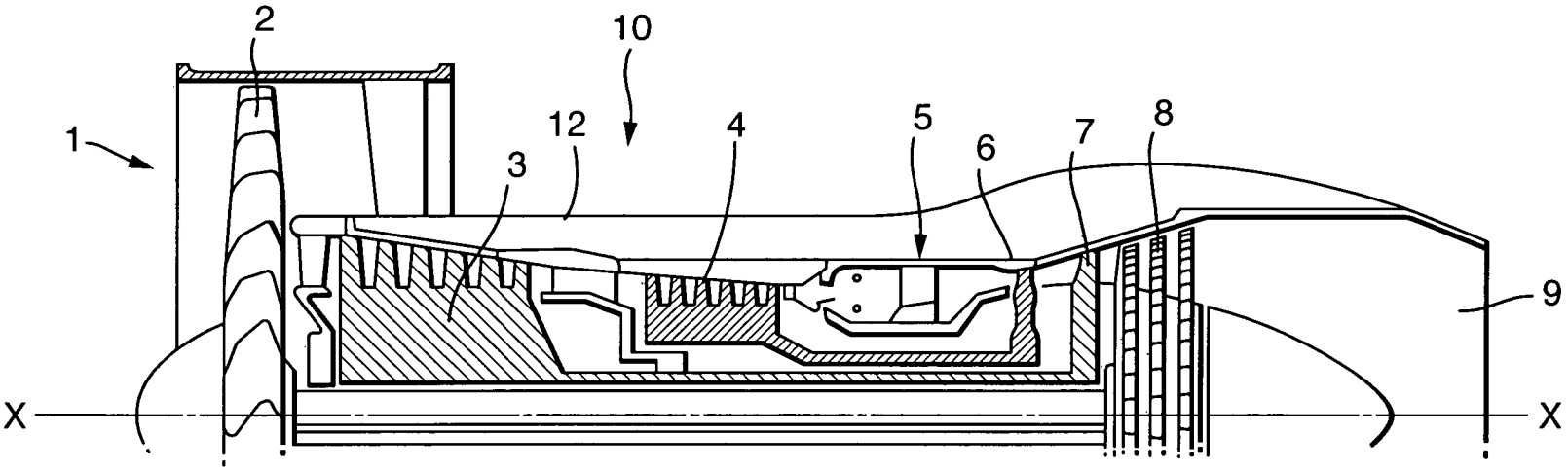
FIG. 1 is a cross-section of a gas turbine engine.
Figure 2:
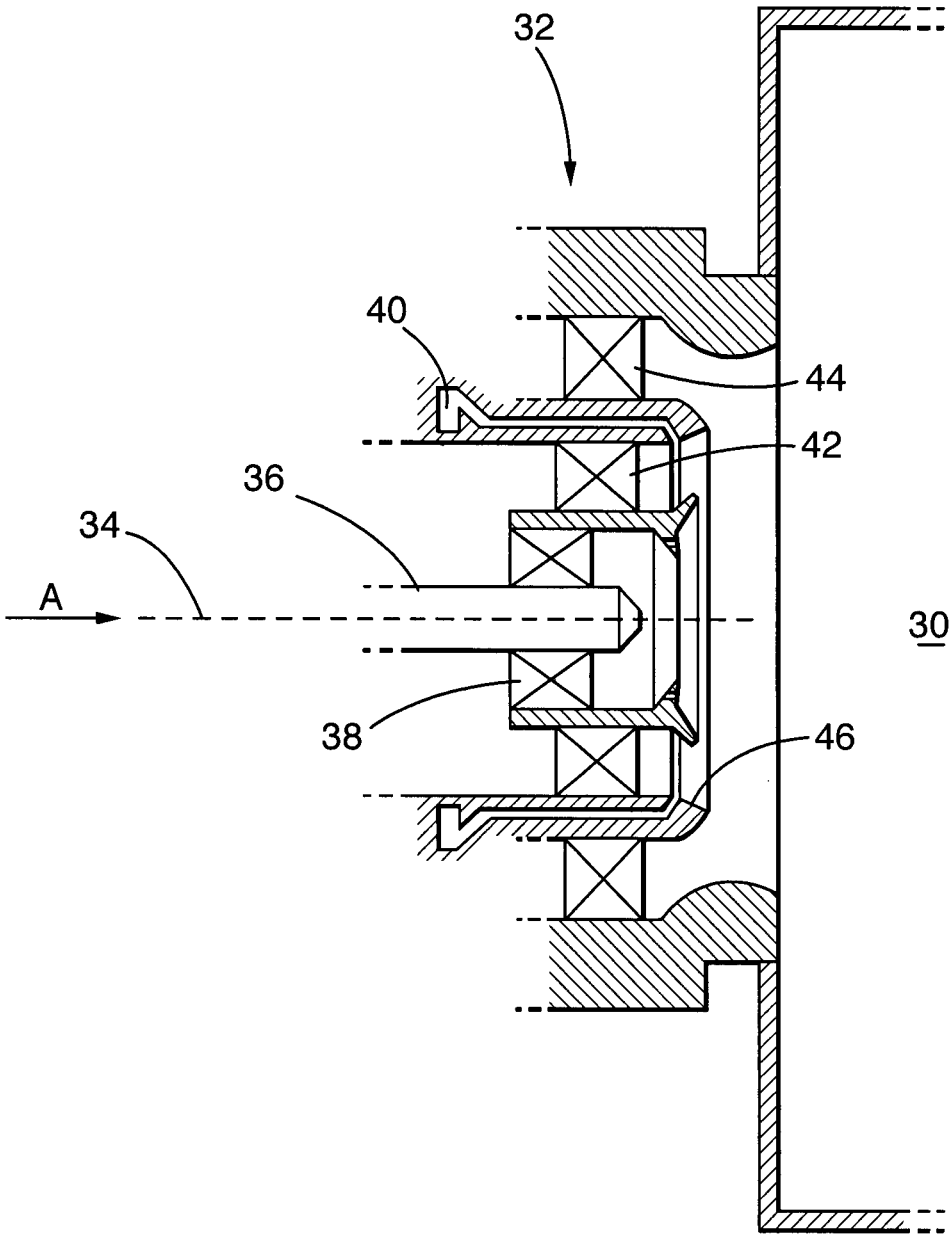
FIG. 2 depicts a cross-section of a fuel injector.

The fuel injector 32 disclosed in FIG. 2 injects a pilot flow of air and fuel and a main flow of air and fuel into a combustor 30. The injector comprises a pilot fuel injector 36 located on the centerline 34 of the fuel injector system 32. A pilot swirler 38, used to swirl air past the pilot fuel injector 36, surrounds the pilot fuel injector 36.

The fuel injector system 32 utilizes a pilot fuel injector 36 of the type commonly referred to as a simplex pressure atomizer fuel injector. As will be understood by those skilled in the art, the simplex pressure atomizer fuel injector 36 atomizes fuel based upon a pressure differential placed across the fuel, rather than atomizing fuel with a rapidly moving air stream as do airblast atomizers.

The fuel injector system 32 further includes a main airblast fuel injector 40 which is concentrically located about the simplex pressure atomizer pilot fuel injector 36. Inner and outer main swirlers 42 and 44 are located concentrically inward and outward of the main airblast fuel injector 40. The simplex pressure atomizer pilot fuel injector 36 and main fuel injector 40 may also be described as a primary fuel injector and a secondary fuel injector, respectively.

As it will be appreciated by those skilled in the art, the main airblast fuel injector 40 provides liquid fuel to an annular aft end or pre-filmer 46 which allows the fuel to flow in an annular film. The annular film of liquid fuel is then entrained in the much more rapidly moving and swirling air streams passing through inner main swirler 42 and outer main swirler 44, which air streams cause the annular film of liquid fuel to be atomized into small droplets. Preferably, the design of the airblast main fuel injector 40 is such that the main fuel is entrained approximately mid-stream between the air streams exiting the inner main swirler 42 and the outer main swirler 44.

All three swirlers 38, 42 and 44 are fed from a common air supply system, and the relative volumes of air which flow through each of the swirlers are dependent upon the sizing and geometry of the swirlers and their associated air passages, and the fluid flow restriction to flow through those passages which is provided by the swirlers and the associated geometry of the air passages. In one exemplary embodiment, the swirlers and passage heights are constructed such that from 5 to 20 percent of total swirler air flow is through the pilot swirler 38, from 30 to 70 percent of total air flow is through the inner main swirler 42 and the balance of total air flow is through the outer main swirler 44.

Each of the inner and outer main swirlers 42 and 44 have a vane configuration, the vane angles of the outer main swirler 44 may be either counter-swirl or co-swirl with reference to the vane angles of the inner main swirler 42. The swirl vanes are typically straight, though they may be curved. The curved axial swirl vanes are provided to reduce the Sauter Mean Diameter of the main fuel spray from the main airblast injector 40 as compared to the Sauter Mean Diameter that would be created when utilizing straight vanes.

Figure 3:
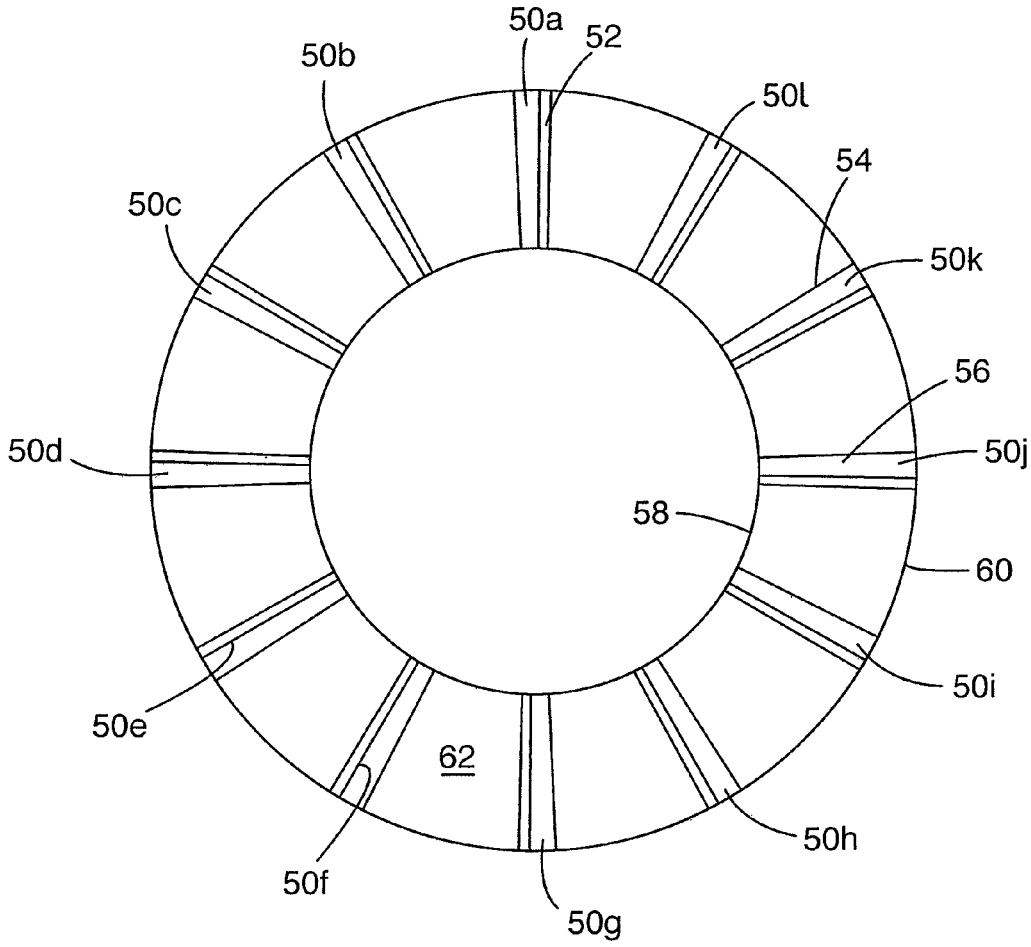
FIG. 3 depicts a view along arrow A of FIG. 2 of a conventional fuel injector having radially extending vanes.

In a conventional fuel injector the vanes extend radially as depicted in FIG. 3.

The vane configuration of the inner main swirler is depicted in more detail with reference to FIG. 3, which is a view along arrow A of FIG. 2 with the other components of the fuel injector removed.

Each of the vanes 50*a* . . . 50*j* comprises a leading edge 52, a trailing edge 54, a pressure flank 56 extending from the leading edge to the trailing edge and a suction flank (not shown) also extending from the leading edge to the trailing edge, and opposed to the pressure flank.

The vane follows a helix as the vane extends axially, the rotation of the helix occurring along a line that coincides with the radius of the swirler. Each of the leading edges 52 and trailing edges 54 extend along a radius of the injector between a hub 58 and a tip 60.

Figure 4:
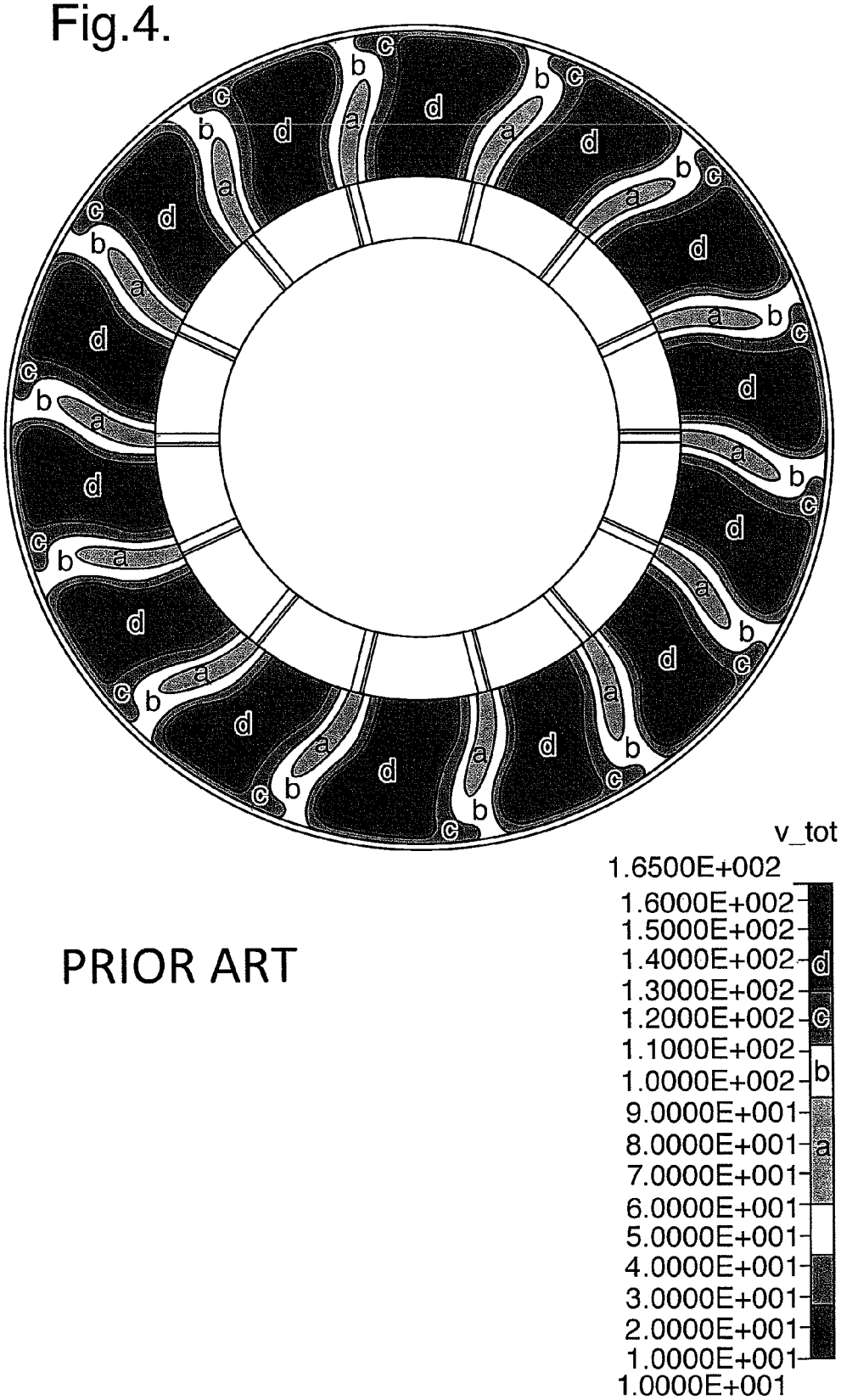
FIG. 4 depicts a velocity contour diagram at the plane of exit of the fuel passages to the pre-filmer according to a conventional fuel injector.

A velocity contour diagram at the plane of exit of the fuel passages to the pre-filmer 46 is depicted in FIG. 4. The mainstream flow through the swirler and away from the swirl vanes travels at a velocity of between 130 and 150 m/sec. The flow through the swirler but closer to the vanes exits the swirl passages at a velocity slower than that of the mainstream flow. The slow travelling air extends downstream of the vane trailing edge onto the surface of the prefilmer.

The Sauter Mean Diameter is inversely proportional to the velocity and therefore can be used to represent the atomisation performance. Where the velocity is lower the atomisation performance is reduced. The reduced atomisation can lead to increased levels of smoke or NOx being emitted from the engine.

With reference to FIG. 2 and the conventional swirler design, at the high air flow rates passing through the swirler, typical of a lean burn injector, it has been found that at the annulus tip for a conventional, radially extending vane the streamline flow within the boundary layer at the annulus wall diverges from the design path determined by the camber line of the vane.

Figure 5:
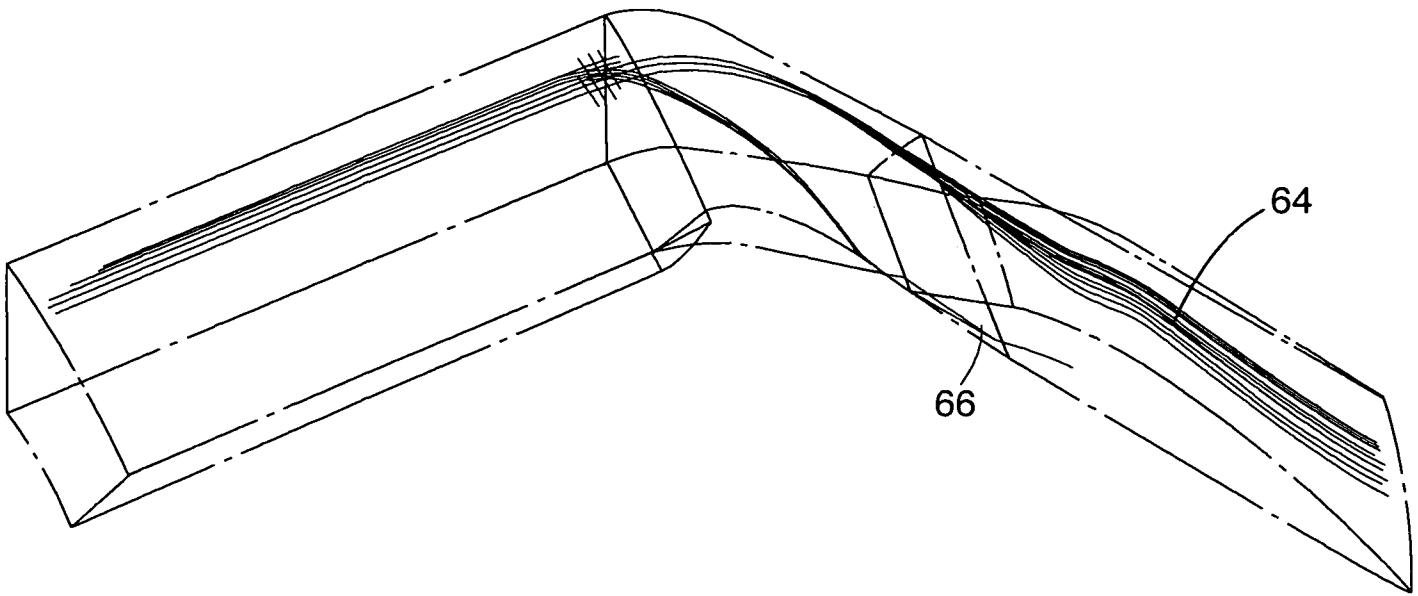
FIG. 5 depicts a view along arrow A of FIG. 2 of swirler vanes according to the invention within the injector of FIG. 2.

This divergence is caused by a strong circumferential drift of the low kinetic energy fluid from the pressure side to the suction side of the vane passage. Across the vane passage 62 a pressure gradient exists between the suction surface and the pressure surface. As depicted in FIG. 5, which is a top view of vane passage 62, the streamline flow 64, just outside the boundary layer follows the pressure surface. In contrast, the boundary layer flow 66 deviates from the pressure surface and drifts circumferentially towards the suction surface because of the pressure gradient across the vane passage 62.

As well as drifting circumferentially towards the suction surface, the flow also experiences radial drift of the boundary layer from the tip of the vane passage towards the hub of the vane passage. The radial drift affects the quality and consistency of the flow over the surface of the prefilmer where the fuel is injected. Deviated and detached flow on the prefilmer leads to poor atomisation performance and high losses and higher than desired NOx results.

Figure 6:
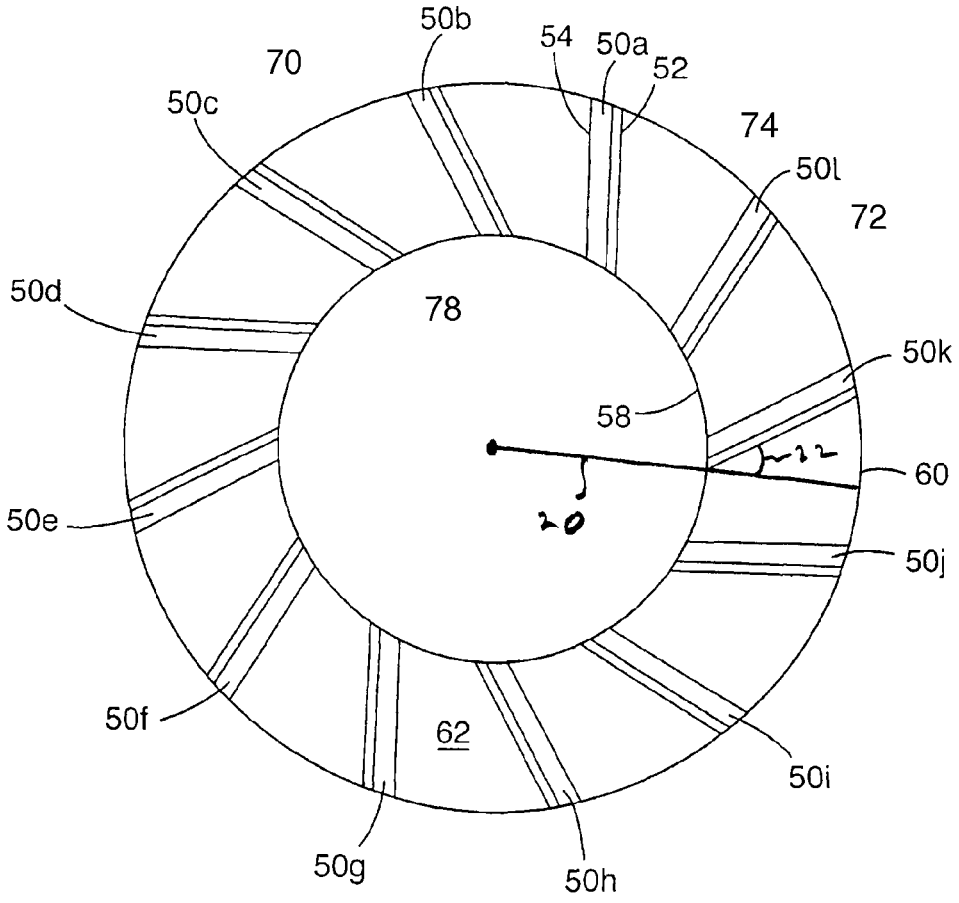
FIG. 6 depicts a view along arrow A of FIG. 2 of the vane configuration of the inner main swirler of the present invention.

The vane configuration of the inner main swirler of the invention is depicted in more detail with reference to FIG. 6, which is a view along arrow A of FIG. 2 with the other components of the fuel injector removed.

Each of the vanes 50*a* . . . 50*l* comprises a leading edge 52, a trailing edge 54, a pressure flank 56 extending from the leading edge to the trailing edge and a suction flank (not shown) also extending from the leading edge to the trailing edge, and opposed to the pressure flank. The suction surface is shown at 72 and the pressure surface is shown at 74. Each of the vanes 50*a* . . . 50*l* extends between the outer periphery 70 and inner periphery 78.

The vane follows a helix as the vane extends axially, the rotation of the helix occurring along a line that coincides with the radius 20 of the swirler. Each of the leading edges 52 and trailing edges 54 is leant at an angle 22 of between 5° and 20°, with respect to the true radius 20 of the injector, between a hub 58 and a tip 60.

Leaning the vanes without adjusting the axial exit angle alleviates the radial pressure gradient without adjusting the permeability of the vanes. One of the effects of leaning the vanes is that radial lift is generated that balances the cross flow pressure gradients in the vane passage.

Figure 7:
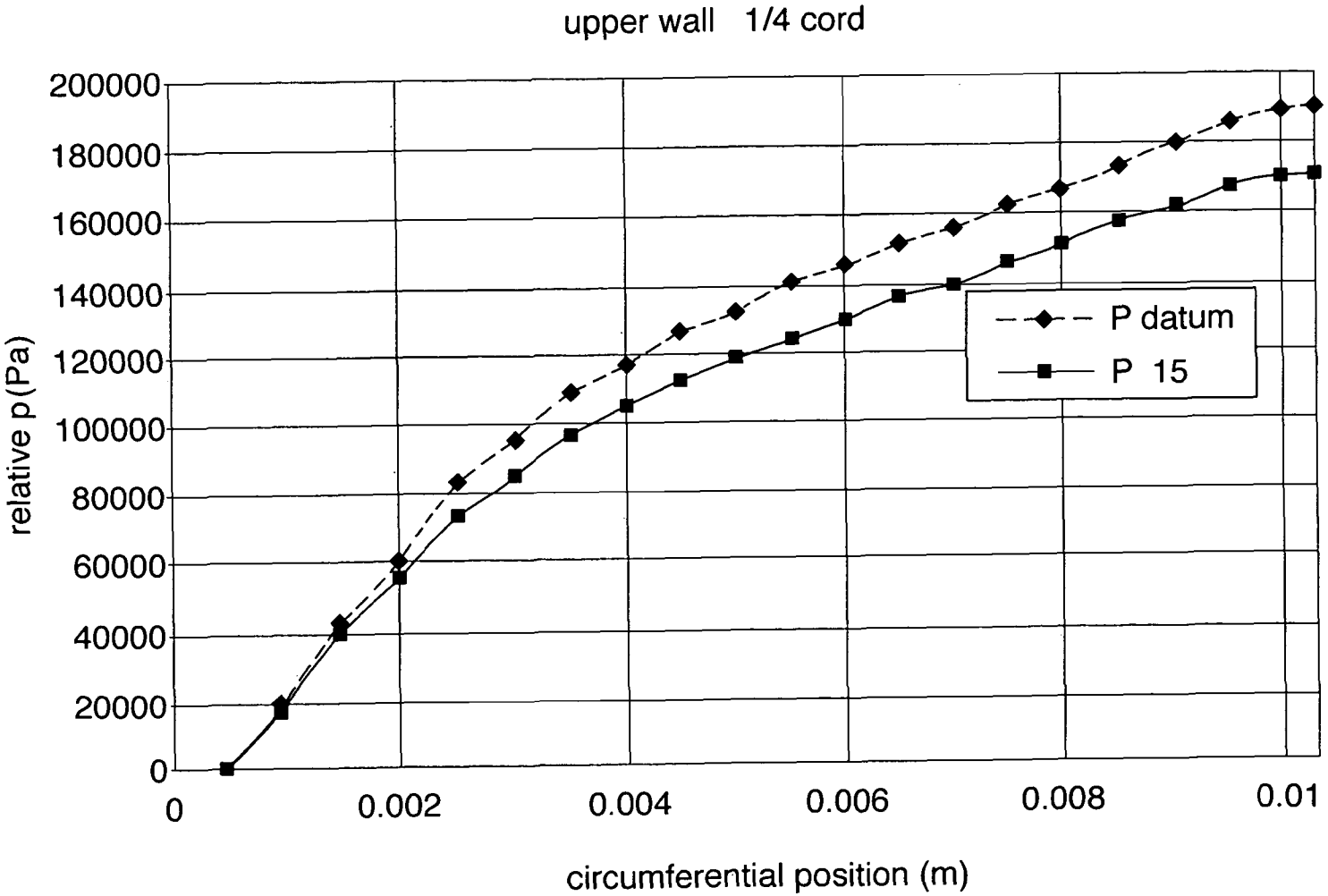
FIG. 7 depicts the stream line flow of a boundary layer along a swirl passage of swirler vanes according to the invention.

FIG. 7 depicts a comparison between the conventional, radial vane geometry and a vane geometry leant at an angle of 15 degrees to the radius. The measurements are taken in a plane perpendicular to the axial direction and lying at ¼ of the chord length of the vane. Static pressure distributions are plotted along the tip and hub walls. The values have been shifted, in to the positive quadrant of the gauge pressures to emphasize the differences in the gradients.

Figure 8:
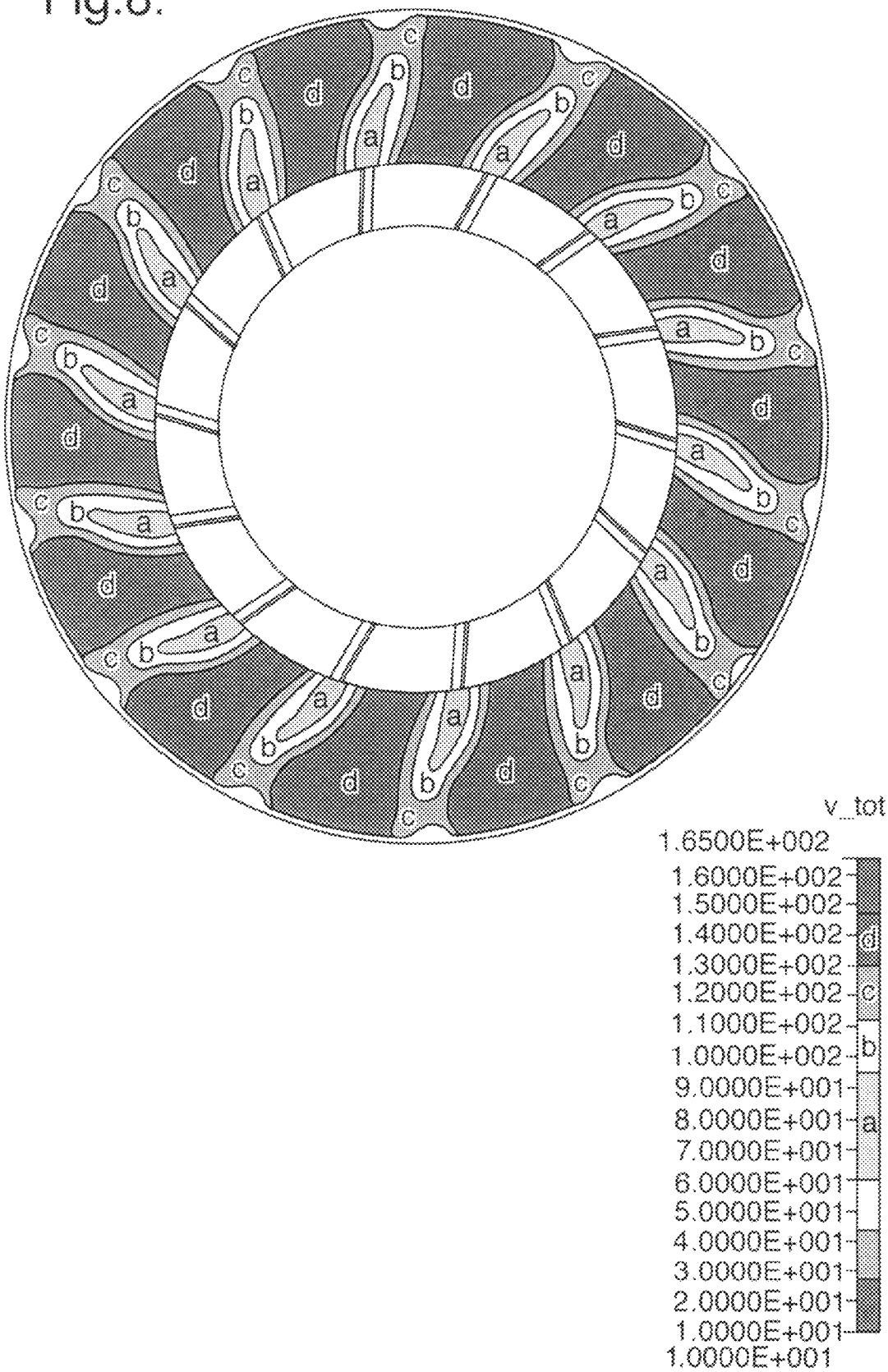
FIG. 8 depicts a velocity contour at the plane where the fuel exits the passage of swirler vanes according to the invention.

Cross-flow is generated within the boundary layer and at a ¼ of the vane length a cross-flow pressure gradient is evident. The cross-flow gradient at the tip is greater than the cross-flow gradient at the hub. By leaning the vanes towards the suction surface of an adjacent vane the relative static pressure is reduced and a less steep pressure curve is exhibited. The weaker pressure gradient diminishes the crossflow The effect of introducing lean to the vane on the velocity of the air to the prefilmer is depicted in FIG. 8. Beneficially, the air leaving the vane passage has a more uniform velocity distribution and a higher average velocity. Greater fuel atomisation is achieved and fuel emissions are reduced.

It will be appreciated that the vane lean may be varied along its radial height. Such that the angle of lean near the hub is less than the angle of lean on portions of the vane further along the radius. Beneficially, the effect of adverse lean near the hub, where an increase in the pressure gradient is observed, is reduced.

We claim:

1. A fuel injector for a combustor of a gas turbine engine, the fuel injector comprising:

swirler means having an outer periphery and an inner periphery arranged coaxially about an axis and a plurality of vanes spaced circumferentially and extending between the inner and outer periphery, each vane has an axially forward leading edge and an axially rearward trailing edge, wherein adjacent vanes define an axially extending vane passage therebetween, the passage extending from the axially forward leading edge to the axially trailing edge, the vanes providing the vane passage with a pressure surface and an opposing suction surface, and wherein the vanes are radially inclined at an angle of between 5° and 20° to the true radius of the injector, and wherein the outer periphery extends axially into a prefilmer, wherein the prefilmer comprises at least one aperture constructed to supply a liquid fuel therethrough and provide a film of the liquid fuel on the prefilmer during use, and the prefilmer is constructed to have the film of liquid fuel contact the air stream exiting the swirler means during use.

2. A combustor assembly incorporating a fuel injector according to claim 1.

3. A gas turbine incorporating a fuel injector according to claim 1.

4. A fuel injector according to claim 1, wherein the outer periphery of each vane passage is defined by a continuous circumferential wall.

5. A fuel injector according to claim 1, wherein the inner periphery of each vane passage is defined by a continuous circumferential wall.

6. A fuel injector according to claim 4, wherein the outer periphery extends axially forward of the plurality of vanes and the outer periphery extends axially rearward of the plurality of vanes.

7. A fuel injector for a combustor of a gas turbine engine, the fuel injector comprising:

swirler means having an outer periphery and an inner periphery arranged coaxially about an axis and a plurality of vanes spaced circumferentially and extending between the inner and outer periphery, adjacent vanes define an axially extending vane passage therebetween, the vanes providing the vane passage with a pressure surface and an opposing suction surface, and the vanes are radially inclined at an angle of between 5° and 20° to the true radius of the injector, the outer periphery extending axially into a prefilmer downstream of the plurality of vanes, wherein the prefilmer comprises at least one aperture constructed to supply a liquid fuel therethrough and provide a film of the liquid fuel on the prefilmer during use, and the prefilmer is constructed to have the film of liquid fuel contact the air stream exiting the swirler means during use.

8. A fuel injector according to claim 7, wherein each vane has an axially forward leading edge and an axially rearward trailing edge.

9. A fuel injector according to claim 7, wherein the outer periphery is defined by a continuous circumferential wall.

10. A fuel injector according to claim 7, wherein the inner periphery is defined by a continuous circumferential wall.

11. A combustor assembly incorporating a fuel injector according to claim 7.

12. A gas turbine incorporating a fuel injector according to claim 7.

13. A method of operating a fuel injector in a combustor of a gas turbine engine, the fuel injector comprising:

swirler means having an outer periphery and an inner periphery arranged coaxially about an axis and a plurality of vanes spaced circumferentially and extending between the inner and outer periphery, each vane has an axially forward leading edge and an axially rearward trailing edge, wherein adjacent vanes define an axially extending vane passage therebetween, the passage extending from the axially forward leading edge to the axially trailing edge, the vanes providing the vane passage with a pressure surface and an opposing suction surface, and wherein the vanes are radially inclined at an angle of between 5° and 20° to the true radius of the injector, and wherein the outer periphery extends axially into a prefilmer, the prefilmer comprises at least one aperture, the method comprising;

flowing air through the passage in a direction from the axially forward leading edge to the axially rearward trailing edge and supplying a liquid fuel to the fuel injector; and supplying liquid fuel through the aperture so that a film of the liquid fuel is present on the prefilmer, and the prefilmer is constructed to have the film of liquid fuel contact the air stream exiting the swirler means.

* * * * *